US006485845B1

(12) United States Patent
Wustman et al.

(10) Patent No.: US 6,485,845 B1
(45) Date of Patent: Nov. 26, 2002

(54) THERMAL BARRIER COATING SYSTEM WITH IMPROVED BOND COAT

(75) Inventors: Roger D. Wustman, Loveland, OH (US); Jeffrey A. Conner, Hamilton, OH (US); Jonathan P. Clarke, West Chester, OH (US); Timothy L. Norris, Hamilton, OH (US); William E. Brummett, II, Clay, KY (US); Thomas E. Mantkowski, Madeira, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/489,719

(22) Filed: Jan. 24, 2000

(51) Int. Cl.[7] ..... B32B 15/04; F03B 3/12

(52) U.S. Cl. ..... 428/633; 428/650; 428/652; 428/469; 428/472.2; 428/632; 428/697; 428/699; 428/701; 428/702; 416/241 R; 416/241 B

(58) Field of Search ..... 428/633, 650, 428/652, 472.2, 469, 701, 632, 702, 697, 699; 416/241 R, 241 B

(56) References Cited

U.S. PATENT DOCUMENTS 5,015,502 A * 5/1991 Strangman et al. ..... 427/248.1
5,624,721 A 4/1997 Strangman
5,780,110 A 7/1998 Schaeffer et al.
6,168,874 B1 * 1/2001 Gupta et al. ..... 428/623

* cited by examiner

*Primary Examiner*—Deborah Jones
*Assistant Examiner*—Jennifer McNeil
(74) *Attorney, Agent, or Firm*—David L. Narciso; Gary M. Hartman; Domenica N.S. Hartman

(57) ABSTRACT

A thermal barrier coating (TBC) system and method for forming the TBC system on a component designed for use in a hostile thermal environment, such as superalloy turbine, combustor and augmentor components of a gas turbine engine. The TBC system exhibits improved spallation resistance as a result of having a bond coat formed to contain a dispersion of oxide particles in its outer surface region. A method for preferentially entrapping oxide particles in a bond coat entails depositing the oxide particles on the surface of the component prior to forming the bond coat, which may be a diffusion aluminide or an aluminized overlay coating. Deposition of the bond coat causes the oxide particles to become dispersed in the outer surface region of the bond coat. A particular feature of this invention is the ability to preferentially entrap oxides of elements that are not present in the bond coat or a substrate region of the component on which the bond coat is formed.

16 Claims, 1 Drawing Sheet

THERMAL BARRIER COATING SYSTEM WITH IMPROVED BOND COAT

FIELD OF THE INVENTION

The present invention relates to processes for depositing protective coatings. More particularly, this invention relates to a process for forming an improved bond coat of a thermal barrier coating system, such as of the type used to protect gas turbine engine components.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor and augmentor. A common solution is to provide turbine, combustor and augmentor components with an environmental coating that inhibits oxidation and hot corrosion, or a thermal barrier coating (TBC) system that thermally insulates the component surface from its operating environment. TBC systems typically include a ceramic layer (TBC) adhered to the component with a metallic bond coat that also inhibits oxidation and hot corrosion of the component surface.

Coating materials that have found wide use as TBC bond coats and environmental coatings include overlay alloy coatings such as MCrAlX where M is iron, cobalt and/or nickel and X is hafnium, zirconium, yttrium, tantalum, platinum, palladium, silicon or a combination thereof. Also widely used are aluminide coatings, which are generally single-layer oxidation-resistant layers formed by a diffusion process, such as pack cementation, above pack, vapor phase, chemical vapor deposition (CVD) or slurry coating processes. The diffusion process results in the coating having two distinct zones, the outermost of which is an additive layer containing an environmentally-resistant intermetallic represented by MAl, where M is iron, nickel or cobalt, depending on the substrate material. Beneath the additive layer is a diffusion zone comprising various intermetallic and metastable phases that form during coating as a result of diffusional gradients and changes in elemental solubility in the local region of the substrate.

Following deposition, the surface of a bond coat is typically prepared for deposition of the ceramic layer by cleaning and abrasive grit blasting to remove surface contaminants, roughen the bond coat surface, and chemically activate the bond coat surface to promote the adhesion of the ceramic layer. Thereafter, a protective oxide scale is formed on the bond coat at an elevated temperature to further promote adhesion of the ceramic layer. The oxide scale, often referred to as a thermally grown oxide (TGO), primarily develops from oxidation of the aluminum and/or MAl constituent of the bond coat, and inhibits further oxidation of the bond coat and underlying substrate. The oxide scale also serves to chemically bond the ceramic layer to the bond coat.

A bond coat is critical to the service life of the thermal barrier coating system in which it is employed, and is therefore also critical to the service life of the component protected by the coating system. During exposure to the oxidizing conditions within a gas turbine engine, bond coats inherently continue to oxidize over time at elevated temperatures, which gradually depletes aluminum from the bond coat and increases the thickness of the oxide scale. Eventually, the scale reaches a critical thickness that leads to spallation of the ceramic layer at the interface between the bond coat and the oxide scale. Once spallation has occurred, the component will deteriorate rapidly, and therefore must be refurbished or scrapped at considerable cost.

In view of the above, there is a continuous effort to improve the spallation resistance of TBC's through improvements to the bond coat. Beneficial results have been achieved by incorporating oxides into the bond coat, as taught by U.S. Pat. No. 5,780,110 to Schaeffer et al. and U.S. Pat. No. 6,168,874 to Gupta et al., both commonly assigned with the present invention. Schaeffer et al. disclose inoculating the surface of a bond coat with a submicron dispersion of oxide particles that act as nucleation sites, thus reducing kinetic barriers to the formation of a desirable $\alpha$-alumina scale at the bond coat-TBC interface. The inoculated bond coat can be preoxidized to form a mature $\alpha$-alumina scale, or a TBC can be immediately deposited, during which the inoculated bond coat forms the desired mature $\alpha$-alumina scale. However, inoculating the bond coat surface prevents or at least limits the type of surface preparation that the bond coat can undergo prior to deposition of the TBC. For example, bond coat surface cleaning and roughening by grit blasting and electropolishing are precluded by the presence of the oxide particles at the bond coat surface. Gupta et al. avoid this complication by disclosing a method by which a diffusion bond coat and oxide particles are codeposited. However, Gupta et al. cannot readily control the types of oxides incorporated into their bond coat. Accordingly, other approaches for promoting the spallation resistance of a TBC through modification of its bond coat would be desirable.

BRIEF SUMMARY OF THE INVENTION

The present invention generally provides a thermal barrier coating (TBC) system and a method for forming the coating system on a component designed for use in a hostile thermal environment, such as superalloy turbine, combustor and augmentor components of a gas turbine engine. The invention is particularly directed to a TBC system that exhibits improved spallation resistance as a result of having a bond coat formed to contain a dispersion of oxide particles in its outer surface region. A particular feature of this invention is the ability to preferentially entrap oxides of elements that are not present in the bond coat or the underlying substrate.

According to this invention, oxide particles are deposited on the surface of the component or an overlay coating deposited on the component surface, after which a diffusion aluminide bond coat is formed. Appropriate deposition of the bond coat causes the oxide particles to become dispersed in its outer surface region, e.g., limited to the additive layer of the diffusion aluminide bond coat. According to this invention, such a dispersion of entrapped oxide particles has been shown to significantly improve spallation resistance of a TBC deposited on a diffusion bond coat. The ability to selectively apply preselected oxide particles to a bond coat surface also provides performance and process advantages. For example, critical surface regions of a bond coat can be specially treated, and oxides of elements not present in the bond coat or substrate yet found to have a particularly beneficial effect can be readily and exclusively incorporated. In addition, this invention is applicable to both new components and those that require or have undergone localized repaired.

Other objects and advantages of this invention will be better appreciated from the following detailed description.

DETAILED DESCRIPTION OF THE INVENTION

Figure 1:
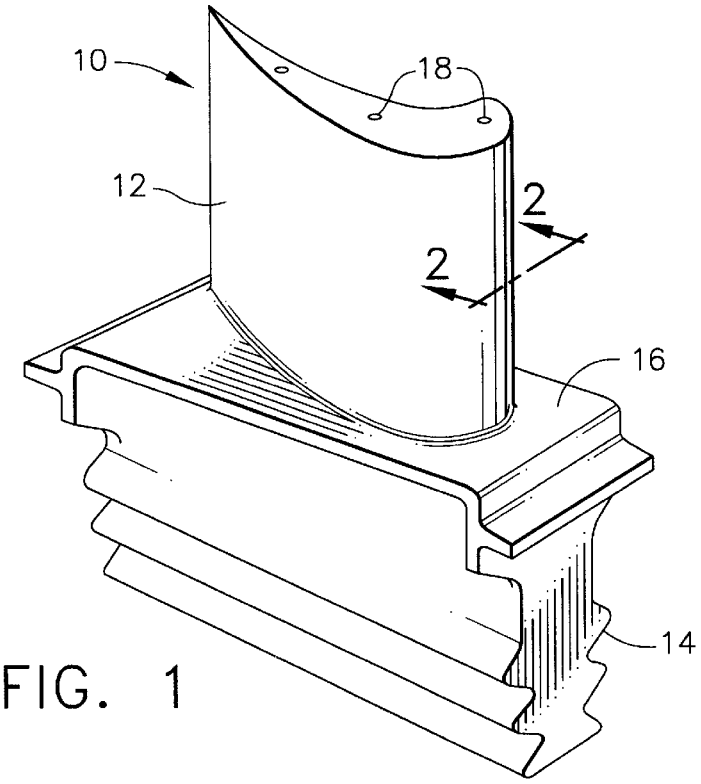
FIG. 1 is a perspective view of a high pressure turbine blade of a gas turbine engine.

The present invention is generally applicable to components that operate within environments characterized by relatively high temperatures, and are therefore subjected to a hostile oxidizing environment and severe thermal stresses and thermal cycling. Notable examples of such components include the high and low pressure turbine nozzles and blades, shrouds, combustor liners and augmentor hardware of gas turbine engines. One such example is the high pressure turbine blade 10 shown in FIG. 1. The blade 10 generally includes an airfoil 12 against which hot combustion gases are directed during operation of the gas turbine engine, and whose surfaces are therefore subjected to severe attack by oxidation, corrosion and erosion. The blade 10 is anchored to a turbine disk (not shown) with a dovetail 14 formed on a root section 16 of the blade 10. Cooling holes 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which a thermal barrier coating system may be used to protect the component from its service environment.

Figure 2:
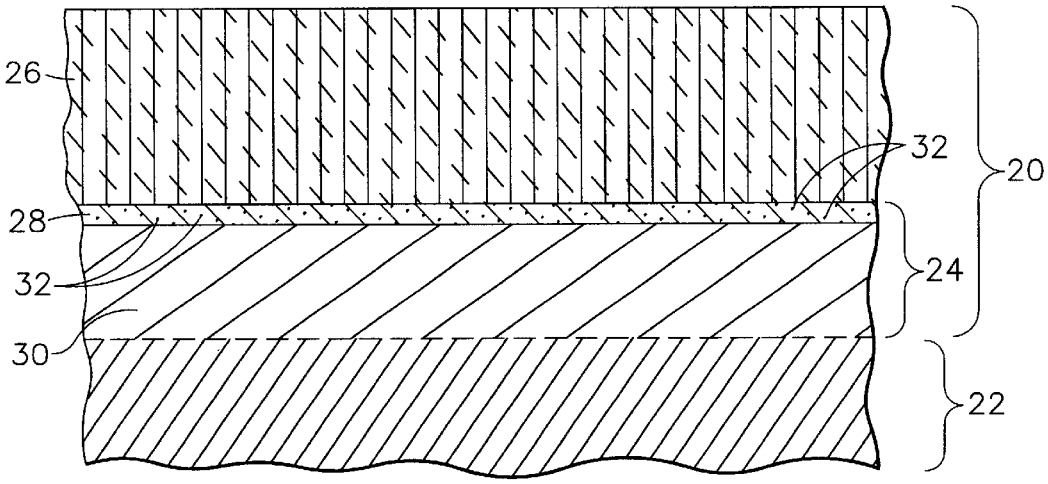
FIG. 2 is a cross-sectional view of a surface region of the blade of FIG. 1, and shows a thermal barrier coating system that incorporates a diffusion bond coat modified to include entrapped oxide particles in accordance with this invention.

Represented in FIG. 2 is a thermal barrier coating system 20 in accordance with an embodiment of this invention. As shown, the coating system 20 includes a ceramic layer 26 bonded to the blade substrate 22 with a diffusion bond coat 24. The blade 10 (and therefore the substrate 22) is preferably a high-temperature material, such as an iron, nickel or cobalt-base superalloy. To attain a strain-tolerant columnar grain structure, the ceramic layer 26 is preferably deposited by physical vapor deposition (PVD), though other deposition techniques could be used. A preferred material for the ceramic layer 26 is an yttria-stabilized zirconia (YSZ), with a preferred composition being about 4 to about 8 weight percent yttria, though other ceramic materials could be used, such as yttria, nonstabilized zirconia, or zirconia stabilized by ceria ($CeO_2$), scandia ($Sc_2O_3$) or other oxides. YSZ is widely employed in the art because it exhibits desirable thermal cycle fatigue properties and can be readily deposited by plasma spray, flame spray and vapor deposition techniques. The ceramic layer 26 is deposited to a thickness that is sufficient to provide the required thermal protection for the underlying substrate 22, generally on the order of about 75 to about 300 micrometers.

As represented in FIG. 2, the bond coat 24 is formed entirely of a diffusion aluminide, though overaluminided overlay coatings such as MCrAlX are also within the scope of this invention. The aluminide bond coat 24 is generally characterized by an additive layer 28 that overlies a diffusion zone 30. The additive layer 28 contains an oxidation-resistant MAl intermetallic phase, such as the nickel-aluminide beta phase (NiAl). The additive layer 28 may also contain PtAl intermetallic phases, usually $PtAl_2$ or platinum in solution in the MAl phase, if platinum was plated or otherwise deposited on the substrate 22 prior to aluminizing. As with prior art thermal barrier coating systems, the surface of the bond coat 24 oxidizes to form an aluminum oxide (alumina) layer (not shown) to which the ceramic layer 26 is chemically bonded. A suitable thickness for the diffusion bond coat 24 shown in FIG. 2 is about 25 to about 150 micrometers. If the bond coat 24 includes an overlay coating such as MCrAlX, a suitable thickness for the bond coat 24 (MCrAlX plus diffusion aluminide) is about 25 to about 375 micrometers, more preferably about 50 to 200 micrometers.

According to this invention, the additive layer 28 of the bond coat 24 includes a dispersion of oxide particles 32 that promote the spallation resistance of the ceramic layer 26. As a result of the process by which the oxide particles 32 are incorporated into the bond coat 24, which will be described below, the oxide particles 32 are not limited to being the oxides of those metals present in the bond coat 24 or at the surface of the substrate 22, such as aluminum, chromium, nickel and platinum. Instead, the particles 32 can be essentially any one or more oxides that can have a beneficial effect on the spallation resistance of the TBC system 20. Examples include simple oxides such as alumina ($Al_2O_3$), chromia ($Cr_2O_3$), nickel oxide (NiO), platinum dioxide ($PtO_2$), hafnia (HfO), yttria ($Y_2O_3$), zirconia ($ZrO_2$) and lanthana ($La_2O_3$), and compound oxides such as NiO—$Cr_2O_3$, $Al_2O_3$—NiO. Also as a result of the process by which the particles 32 are incorporated, oxides having a particularly desirable crystal structure or size can be selected. A preferred crystal structure is the rhombohedral crystal structure of $\alpha$-alumina, which is believed to promote the formation of a predominantly $\alpha$-alumina scale at the bond coat-TBC interface. According to commonly-assigned U.S. Pat. No. 5,780,110 to Schaeffer et al., a "mature" (at least 90% $\alpha$-alumina) alumina scale enhances the adhesion of a ceramic thermal barrier coating. For this reason, $\alpha$-alumina, $\alpha$-$Fe_2O_3$, hafnia, yttria and/or chromia are particularly suitable for the oxide particles 32. A suitable particle size for the oxide particles is −325 mesh (less than about 45 micrometers), though smaller and larger particles could be used.

While not wishing to be limited to any particular theory, the improved spallation resistance attributed to this invention may be the result of the oxide particles 32 defining a barrier that limits diffusion of elements from the substrate 22 to the bond coat/TBC interface, thereby limiting the potential for these elements to form oxides that are detrimental to adhesion of the ceramic layer 26. Another possible explanation may be that the oxide particles 32 create a tortuous path for crack propagation along the bond coat/TBC interface, and therefore act to limit crack propagation along this interface. Other possible explanations may be that the oxide particles 32 create preferred sites for improving anchoring of the ceramic layer 26, and/or that local modification of the bond coat surface and/or chemistry provides for an improved bond between the ceramic layer 26 and the bond coat 24. It is possible that any or all of these explanations may apply, or that other possible explanations exist.

As a result of the manner in which they are incorporated, the particles 32 are dispersed in the additive layer 28 of the diffusion bond coat 24, so as to be concentrated at the bond coat-TBC interface. By being concentrated at the surface of the bond coat 24, it is believed that the oxide particles 32 are more capable of creating preferred sites for improving anchoring of the ceramic layer 26, and limiting crack propagation along the bond coat-TBC interface. To achieve these advantages, a sufficient amount of oxide particles 32 should be present in the bond coat 24. Suitable results have been obtained with an oxide content of up to about 50 volume percent, though it is foreseeable that greater or lesser oxide contents may be sufficient.

Several methods are possible by which the oxide particles 32 can be deposited on the substrate 22 for incorporation into the bond 24. Examples of suitable processes include slurry coating, metallo-organic chemical vapor deposition and electron beam physical vapor deposition (EBPVD). The diffusion aluminide bond coat 24 shown in FIG. 2 is then formed by such methods as pack cementation or a vapor phase aluminizing process such as vapor phase deposition, chemical vapor deposition (CVD) and above-pack (out-of-pack) deposition. These processes are well known in the art, and are conventionally carried out in an inert atmosphere within a coating chamber. If the bond coat 24 includes an overlay coating, such well-known deposition methods as physical vapor deposition, air plasma, or low pressure plasma processes may be employed to deposit the overlay coating prior to application of the oxide particles and the diffusion coating.

During an investigation leading to this invention, nickel-base superalloy specimens were coated with thermal barrier coating systems whose bond coats were diffusion platinum aluminides. The oxide particle dispersion of this invention was incorporated into limited regions of the bond coats, while other regions of the bond coats remained oxide-free. The specimens were formed of the nickel-base superalloy René N5 having a nominal composition, by weight, of about 7.5 cobalt, 7.0 chromium, 1.5 molybdenum, 5.0 tungsten, 3.0 rhenium, 6.5 tantalum, 6.2 aluminum, 0.15 hafnium, 0.05 carbon, 0.004 boron, with the balance nickel and incidental impurities. The bond coats were formed by plating and then diffusing a 7 $\mu$m-thick layer of platinum into the surfaces of the specimens in accordance with known methods. A slurry was then prepared by suspending about 75 grams of an alumina powder in about 150 ml of NICROBRAZE cement. The alumina particles had an average particle size of less than 45 $\mu$m. After agitating the slurry to create a relatively uniform suspension of alumina in the NICROBRAZE, the slurry was applied to the limited surface regions of the specimens.

The slurry-coated surfaces of the specimens were then aluminized using a conventional vapor phase deposition process conducted at about 1080° C. (about 1975° F.) to produce diffusion bond coats with additive layers having thicknesses of about 25 to 50 $\mu$m (about 0.001 to 0.002 inch). As a result of the aluminizing process, the alumina particles are concentrated at or near the surface of the bond coats. After cleaning, roughening and activating the bond coat surfaces by abrasive grit blasting, YSZ TBC was deposited on each of the specimens by PVD to a nominal thickness of about 125 to 150 $\mu$m. The specimens were then furnace cycle tested (FCT) at about 2075° F. (about 1135° C.) until spallation of more than 50% of the TBC had occurred. At the conclusion of the test, virtually all of the TBC applied over those portions of the bond coats containing entrapped oxide particles was still intact, while virtually all TBC applied over those portions of the bond coats that did not contain entrapped oxide particles had spalled. From this testing, it was concluded that platinum-aluminide bond coats incorporating a dispersion of alumina oxide particles in accordance with this invention were capable of thermal cycle lives superior to those achieved with conventional platinum-aluminide bond coats.

While the invention has been described in terms of a preferred embodiment, it is apparent that other forms could be adopted by one skilled in the art. Accordingly, the scope of the invention is to be limited only by the following claims.

What is claimed is:

1. A component having a thermal barrier coating system on a surface thereof the coating system comprising:

a diffusion aluminide bond coat on the surface of the component, the bond coat comprising an additive layer on the surface of the component and a diffusion zone extending into the surface of the component, the bond coat containing oxides dispersed only in the additive layer; and a ceramic layer on an outer surface of the bond coat so as to define an interface between the bond coat and the ceramic layer, the oxides being concentrated at the interface.

2. A component according to claim 1, wherein the bond coat contains up to about 50 volume percent of the oxides.

3. A component according to claim 1, wherein the oxides have particle sizes of up to about 45 micrometers.

4. A component according to claim 1, wherein the dispersion of oxides further comprises oxides of at least one element chosen from the group consisting of aluminum, chromium, nickel, cobalt, iron, yttrium, hafnium, zirconium and lanthanum.

5. A component according to claim 1, wherein the coating system further comprises an MCrAlX overlay coating where M is iron, nickel and/or cobalt and X is hafnium, zirconium, yttrium, tantalum, platinum, palladium, silicon or a combination thereof the additive layer overlying the MCrAlX overlay coating and the diffusion zone extending into the MCrAlX overlay coating.

6. A component according to claim 1, wherein each of the oxides dispersed in the bond coat has a rhombohedral crystal structure.

7. A component according to claim 6, further comprising an oxide layer between the bond coat and the ceramic layer, the oxide layer being predominantly $\alpha$-alumina.

8. A component according to claim 1, wherein the ceramic layer has a columnar grain structure.

9. A component according to claim 1, wherein the oxides are dispersed on only limited surface regions of the component.

10. A component according to claim 1, wherein the oxides are only located at and near the outer surface of the bond coat.

11. A gas turbine engine component having a thermal barrier coating system on a surface thereof, the coating system comprising:

a diffusion aluminide bond coat on the surface of the component, the bond coat comprising an additive layer on the surface of the component, a diffusion zone extending into the surface of the component, and a dispersion of oxides located only at and near an outer surface of the additive layer, the oxides comprising an oxide of at least one element not present in a remainder of the bond coat or a substrate region of the component beneath the surface of the component; and a ceramic layer on the outer surface of the additive layer of the bond coat so that the oxides are concentrated at an interface between the bond coat and the ceramic layer.

12. A gas turbine engine component according to claim 11, wherein the oxides are dispersed on only limited surface regions of the component.

13. A gas turbine engine component according to claim 11, wherein at least some of the oxides dispersed in the bond coat have a rhombohedral crystal structure.

14. A gas turbine engine component according to claim 11, further comprising an oxide layer between the bond coat and the ceramic layer, the oxide layer being predominantly $\alpha$-alumina.

15. A gas turbine engine component according to claim 11, wherein the ceramic layer has a columnar grain structure.

16. A component having a thermal barrier coating system on a surface thereof the coating system comprising:

a bond coat on the surface of the component, the bond coat containing oxide particles dispersed only at and near an outer surface of the bond coat and on only limited surface regions of the bond coat; and a ceramic layer on the outer surface of the bond coat.

* * * * *